US011591877B2

(12) United States Patent
Qureshi et al.

(10) Patent No.: US 11,591,877 B2
(45) Date of Patent: Feb. 28, 2023

(54) ROTATING TUBING HANGER FOR CEMENTED COMPLETION

(71) Applicant: Saudi Arabian Oil Company, Dhahran (SA)

(72) Inventors: Muhammad Ali Qureshi, Abqaiq (SA); Bilal Tariq, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/230,216

(22) Filed: Apr. 14, 2021

(65) Prior Publication Data

US 2022/0333455 A1 Oct. 20, 2022

(51) Int. Cl.
*E21B 33/04* (2006.01)
*E21B 43/10* (2006.01)

(52) U.S. Cl.
CPC ..... *E21B 33/0415* (2013.01); *E21B 43/10* (2013.01)

(58) Field of Classification Search
CPC ..... E21B 33/0415; E21B 43/10
See application file for complete search history.

(56) References Cited

U.S. PATENT DOCUMENTS

| | | | | |
|---|---|---|---|---|
| 8,528,650 | B1 * | 9/2013 | Smith | E21B 19/06 166/208 |
| 9,458,690 | B2 | 10/2016 | Moellendick | |
| 9,689,229 | B2 | 6/2017 | Hanson et al. | |
| 9,909,385 | B2 | 3/2018 | Cocker, III et al. | |
| 10,494,889 | B2 * | 12/2019 | Robottom | E21B 33/0422 |
| 11,215,038 | B2 * | 1/2022 | Cotton | E21B 17/06 |
| 2015/0247387 | A1 | 9/2015 | Massey et al. | |
| 2017/0122042 | A1 * | 5/2017 | Travis | E21B 17/043 |
| 2017/0167218 | A1 * | 6/2017 | Cheah | E21B 23/02 |
| 2022/0081989 | A1 * | 3/2022 | Muballa | E21B 19/166 |

OTHER PUBLICATIONS

Schlumberger, "Rotating Mandrel Casing Hanger" Cameron A Schlumberger Company, Brochure, 2016, 1 page.
Bowman et al., "How to Run and Cement Liners," Part 1, World Oil Magazine, May 1988, 6 pages.

* cited by examiner

*Primary Examiner* — Aaron L Lembo
(74) *Attorney, Agent, or Firm* — Fish & Richardson P.C.

(57) ABSTRACT

A method includes positioning a casing into a wellbore. Cement is pumped through the casing to cement the casing in the wellbore. A casing hanger is positioned within a casing head spool that is part of a surface wellhead assembly at an uphole end of the wellbore. The casing hanger is attached to an uphole end of the casing. A production tubing string including a plurality of production tubing segments is positioned within the casing within the wellbore. An uphole end of the production tubing string is attached to a lower end of a rotating inner mandrel of a production tubing hanger. The production tubing hanger is configured be positioned within a tubing head spool positioned above the casing head spool within the surface wellhead assembly. The rotating inner mandrel is configured to rotate within a non-rotating housing of the production tubing hanger. The production tubing string is rotated by rotating a landing joint including a production tubing segment attached to an upper end of the rotating inner mandrel. While rotating the production tubing string, cement is pumped through the production tubing string to at least partially cement the production tubing string within the wellbore.

13 Claims, 6 Drawing Sheets

ROTATING TUBING HANGER FOR CEMENTED COMPLETION

TECHNICAL FIELD

This disclosure relates to a method and system for rotating a production tubing string in a cemented well completion.

BACKGROUND

Wells for hydrocarbon production or other applications are completed and made ready for production by cementing a casing within the wellbore and inserting a production tubing string within the casing. Hydrocarbons or other fluids can be produced from a subterranean formation up through the production tubing string.

In a conventional completion, production packers are positioned on the production tubing string to isolate and seal the annulus around the exterior of the production tubing. In a so-called "cemented completion," in contrast, isolation of the annulus around the exterior of the production tubing is accomplished by cementing the production tubing within the wellbore. In some cemented completions, no production packers are used, as the cement around the production tubing string acts to center the production tubing string and seal the annulus such that no packers are necessary.

SUMMARY

This disclosure relates to a method and system for rotating a production tubing string in a cemented well completion.

Certain aspects of the subject matter herein can be implemented as a method including positioning a casing into a wellbore. Cement is pumped through the casing to cement the casing in the wellbore. A casing hanger is positioned within a casing head spool that is part of a surface wellhead assembly at an uphole end of the wellbore. The casing hanger is attached to an uphole end of the casing. A production tubing string including a plurality of production tubing segments is positioned within the casing within the wellbore. An uphole end of the production tubing string is attached to a lower end of a rotating inner mandrel of a production tubing hanger. The production tubing hanger is configured be positioned within a tubing head spool positioned above the casing head spool within the surface wellhead assembly. The rotating inner mandrel is configured to rotate within a non-rotating housing of the production tubing hanger. The production tubing string is rotated by rotating a landing joint including a production tubing segment attached to an upper end of the rotating inner mandrel. While rotating the production tubing string, cement is pumped through the production tubing string to at least partially cement the production tubing string within the wellbore.

An aspect combinable with any of the other aspects can include the following features. The production tubing string is rotated before landing the production tubing string at a final depth by rotating the rotating inner mandrel with the landing joint before positioning the production tubing hanger within the tubing head spool.

An aspect combinable with any of the other aspects can include the following features. Hydrocarbons are produced through the production tubing string, wherein produced hydrocarbons are in contact with an interior surface of the production tubing string.

An aspect combinable with any of the other aspects can include the following features. The production tubing hanger includes a plurality of anti-rotation locks within the non-rotating housing which limit rotation of the rotating inner mandrel to one of a clockwise direction or a counterclockwise direction.

An aspect combinable with any of the other aspects can include the following features. The anti-rotation locks include a plurality of wedge-shaped profiles within the non-rotating housing.

An aspect combinable with any of the other aspects can include the following features. The rotating inner mandrel includes a mandrel collar extending circumferentially from an outer surface of the rotating inner mandrel. The production tubing hanger includes a bearing in contact with the mandrel collar and positioned between the rotating inner mandrel and the non-rotating housing. An upper seal element and a lower seal element are positioned within the hanger and within an annular space between the rotating inner mandrel and the non-rotating housing. The upper sealing element is positioned above the mandrel collar and the lower sealing element is positioned below the mandrel collar.

An aspect combinable with any of the other aspects can include the following features. The landing joint is attached to the rotating inner mandrel with threads.

An aspect combinable with any of the other aspects can include the following features. A bottom portion of the production tubing string is cemented into the wellbore, thereby forming a partially cemented long-string completion.

Certain aspects of the subject matter herein can be implemented as a hydrocarbon production system including a casing hanger positioned within a casing head spool that is part of a surface wellhead assembly at an uphole end of a wellbore. A casing is cemented into the wellbore. An upper end of the casing is attached to the casing hanger. A production tubing hanger is configured to be positioned within a tubing head spool positioned above the casing head spool within the surface wellhead assembly. The production tubing hanger includes a rotating inner mandrel within a non-rotating housing, the rotating inner mandrel including a mandrel collar extending circumferentially from an outer surface of the rotating inner mandrel and in contact with a bearing positioned between the rotating inner mandrel and the non-rotating housing. An upper seal element and a lower seal element are positioned within the hanger and within an annular space between the rotating inner mandrel and the non-rotating housing. The upper sealing element is positioned above the mandrel collar and the lower sealing element is positioned below the mandrel collar. A production tubing string is positioned within the casing. An upper end of the production tubing string is attached to a lower end of the rotating inner mandrel. The production tubing string includes a plurality of production tubing segments. The production tubing string is at least partially cemented into the wellbore by pumping cement into the production tubing string while the production tubing string is rotated, wherein rotation of the production tubing string is by rotating a landing joint comprising a production tubing segment attached to an upper end of the rotating inner mandrel.

An aspect combinable with any of the other aspects can include the following features. The production tubing hanger further comprises a plurality of anti-rotation locks within the non-rotating housing which limit rotation of the rotating inner mandrel to one of a clockwise direction or a counterclockwise direction.

An aspect combinable with any of the other aspects can include the following features. The anti-rotation locks include a plurality of wedge-shaped profiles within the non-rotating housing.

An aspect combinable with any of the other aspects can include the following features. The landing joint is attached to the rotating inner mandrel with threads.

An aspect combinable with any of the other aspects can include the following features. Tie bolts lock the production tubing hanger within the tubing head spool.

An aspect combinable with any of the other aspects can include the following features. A bottom portion of the production tubing string is cemented into the wellbore, thereby forming a partially cemented long-string completion.

An aspect combinable with any of the other aspects can include the following features. Hydrocarbons are produced through the production tubing string, wherein produced hydrocarbons are in contact with an interior surface of the production tubing string.

DETAILED DESCRIPTION

In contrast to a conventional completion (wherein production packers are positioned on the production tubing string to isolate and seal the annulus around the exterior of the production tubing), in a so-called "cemented completion," isolation of the annulus around the exterior of the production tubing is accomplished by cementing the production tubing within the wellbore. In a cemented completion, the cement layer isolates the annulus between the exterior of the production tubing string and the wellbore (and/or between the exterior of the tubing string and the interior of the liner or casing). In some cemented completions, no production packers are attached to the production tubing. In some cemented completions, production packers are used in conjunction with the cement layer around the production tubing to provide an additional mechanical barrier.

Rotation of the production tubing string during the cementing of the production tubing string in the wellbore for a cemented completion can ensure a more even distribution of cement in the annulus between the exterior of the production tubing string and the wellbore, particularly in deep, horizontal, and/or highly deviated wells. This can, in turn, improve sealing effectiveness of the cement sheath since it is the primary barrier in this type of completion.

In addition, rotation of the production tubing string as the string is being landed at its final depth can help to prevent the string from becoming stuck and/or free the string if stuck during such lowering operations.

The production tubing hanger, system, and method of the present disclosure allows for rotation of the production tubing string both during landing operations and during cementing operations for a cemented completion well system. In accordance with an embodiment of the present disclosure, no specialized rotation tool is required. Instead, rotation can be via a standard landing joint. An anti-rotation mechanism is included within the production tubing hanger to enable removal of the landing joint.

In accordance with an embodiment of the present disclosure, upper and lower seal elements are included within the housing of the production tubing hanger to prevent migration of fluids in the annulus between the rotating inner mandrel and the housing. Thus, no separate pack-off or other additional external sealing components are required to prevent such migration through the annulus around the exterior of the rotating inner mandrel.

The rotating tubing hanger of the present disclosure can also be utilized in other completion types (such as conventional completions) in other situations where a rotation of the production tubing string is desired.

Figure 1A:
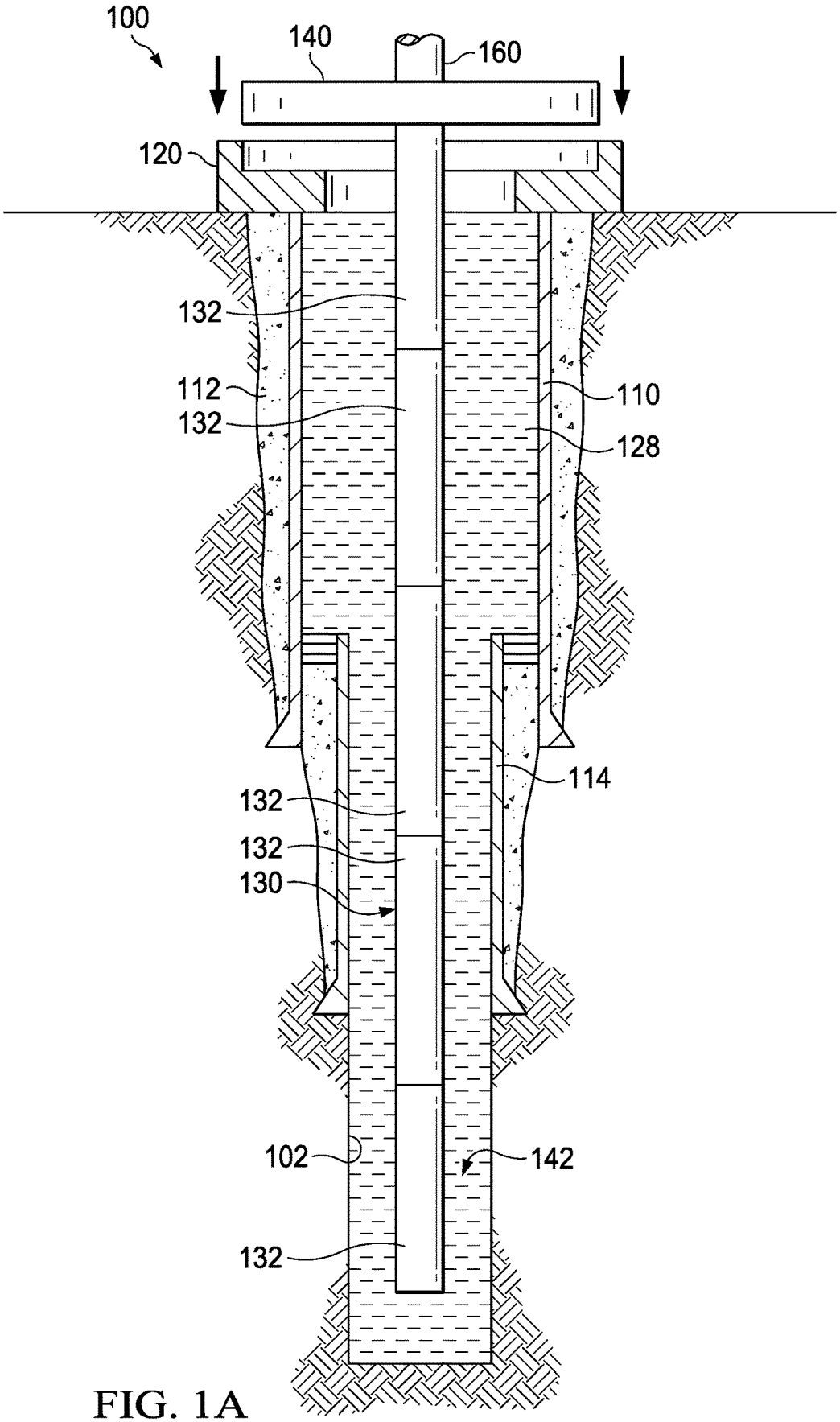
FIGS. 1A-1B are schematic drawings of construction of a well system with a cemented completion and a rotating-mandrel production tubing hanger in accordance with an embodiment of the present disclosure.
Figure 1B:
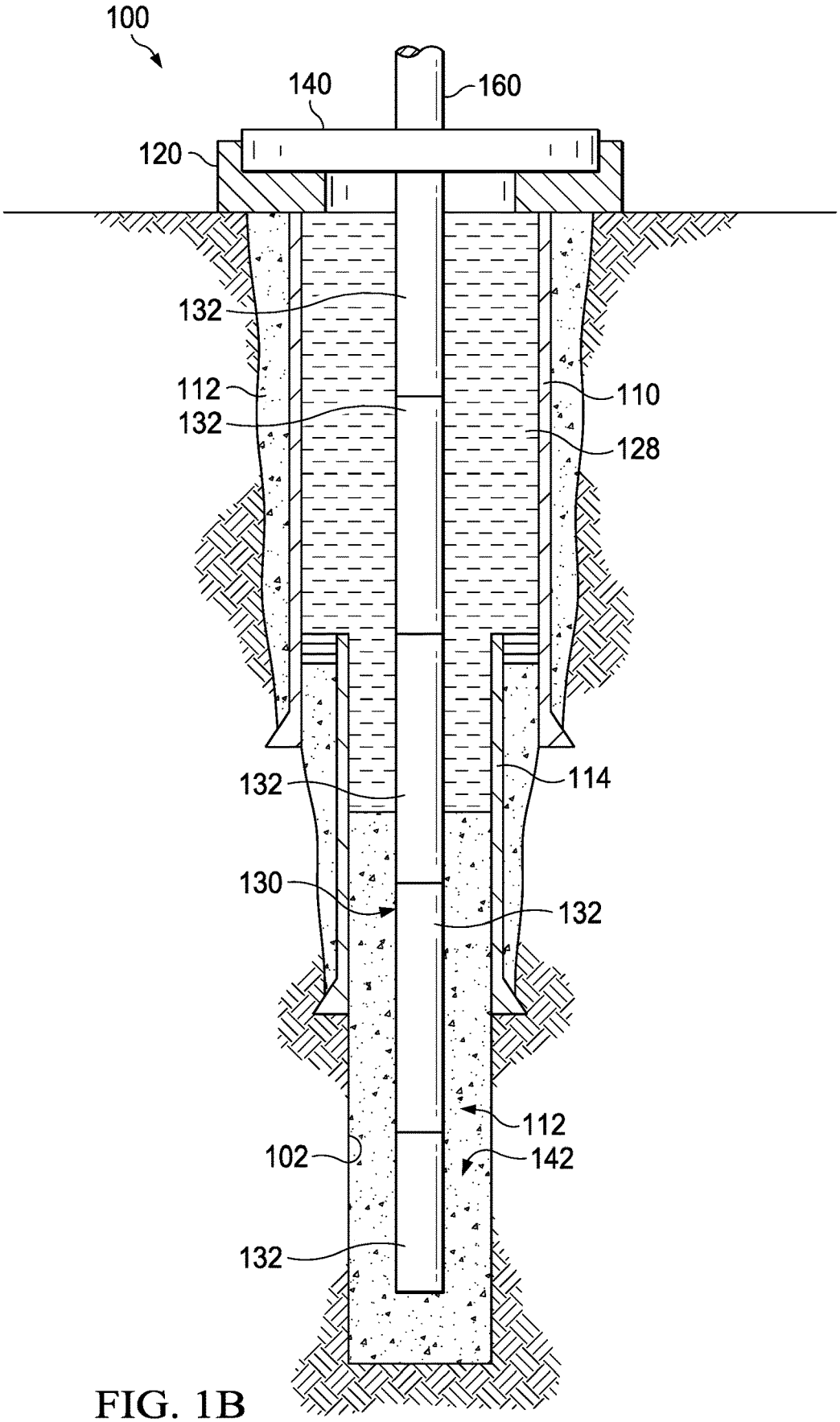

FIGS. 1A-1B are schematic drawings of construction of a well system with a cemented completion and a rotating-mandrel production tubing hanger in accordance with an embodiment of the present disclosure.

More specifically, the embodiment illustrated in FIGS. 1A-1B is a so-called partially cemented long-string completion (PCLS), wherein the top of the production tubing string is hung from a tubing hanger at the surface and only the bottom portion of the production tubing string is cemented into the wellbore.

Referring to FIG. 1A, well system 100 includes a wellbore 102 drilled into the subsurface of the Earth. A casing string 110 comprising a plurality of casing segments has been cemented into the wellbore using conventional methods. Specifically, in accordance with such conventional methods, cement 112 can be pumped down the central bore of casing string 110 after it has been positioned at its final depth. The cement 112 exits the bottom end of casing string 110 and travels upwards to fill the annulus between casing string 110 and wellbore 102. A wiper plug or similar device follows the cement, and a displacement fluid 128 above the plug fills the central bore as the cement fills the annulus. In an embodiment of the present disclosure, casing string 110 is a 9⅝" casing string.

Surface wellhead assembly 120 is positioned at a surface location at an uphole end of wellbore 102. Surface wellhead assembly 120 includes a casing hanger within a casing spool. After cementing the casing in the wellbore, the top end of the casing is attached to the casing hanger. Surface wellhead assembly 120 is described in more detail in reference to FIG. 3.

A liner 114 can be positioned in the wellbore and cemented into place using conventional cementing techniques as described above with respect to casing string 110. In an embodiment of the present disclosure, liner 114 is a 7" liner. In the illustrated embodiment, the top of liner 114 is proximate to the bottom end of casing string 110.

Production tubing string 130 comprises a plurality of production tubing segments 132. After casing string 110 and liner 114 have been cemented within the wellbore, production tubing string 130 is lowered into the wellbore within casing string 110, segment by segment. Centralizers (not shown) are used to centralize production tubing string 130 within wellbore 102. In an embodiment of the present disclosure, production tubing string 130 is a 4½" production tubing string.

As production tubing string 130 approaches its final depth and the final (top) tubing segment is attached to production tubing string 130, the top end of the top tubing segment is attached to a production tubing hanger 140. More specifically, production tubing hanger 140 (which is described in more detail in FIG. 2) includes a rotating inner mandrel within a non-rotating housing, with the mandrel having a mandrel lower end and a mandrel upper end, each of which is threaded. The top end of the final (top) production tubing segment of production tubing string 130 is attached to the mandrel lower end of production tubing hanger 140 via premium threaded connections.

A lower end of a landing joint 160 is made up to the mandrel upper end of production tubing hanger 140. In some embodiments, landing joint 160 comprises a production tubing segment similar or identical to the production tubing segments which comprise production tubing string 130.

A top drive (not shown) supports the landing joint 160 as landing joint 160, production tubing hanger 140, and production tubing string 130 are lowered to their final position. As the production tubing hanger 140 approaches surface wellhead assembly 120, the top drive can impart rotation in landing joint 160 which in turn rotates the rotating inner mandrel of production tubing hanger 140, which in turn rotates production tubing string 130. Such rotation can help prevent production tubing string 130 from becoming stuck in the wellbore during such lowering operations, and/or free production tubing string 130 if stuck, particularly if wellbore 102 is a long, deep, and/or highly deviated wellbore.

Figure 4:
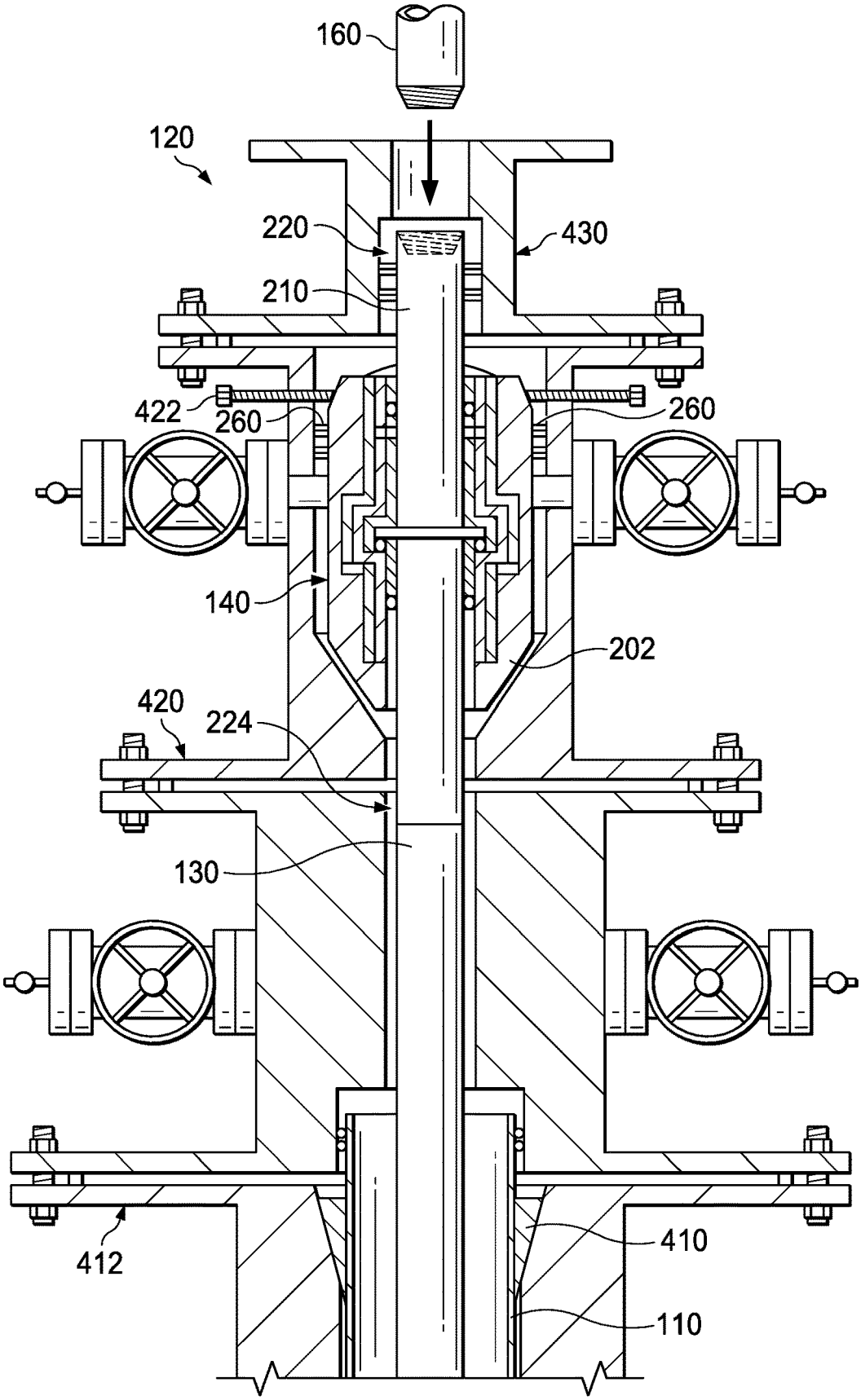
FIG. 4 is a schematic drawing of a surface wellhead assembly with a rotating-mandrel production tubing hanger in accordance with an embodiment of the present disclosure.

When production tubing string 130 has reached its final depth, as shown in FIG. 1B, production tubing hanger 140 is positioned within a tubing head spool that is part of surface wellhead assembly 120 and locked into place with tie-down bolts (see FIG. 4).

Referring to FIG. 1B, after production tubing hanger 140 is locked into place within surface wellhead assembly 120, cementing operations for the cemented completion can begin. Specifically, cement 112 is pumped down the central bore of the production tubing string 130 and out the bottom end of production tubing string 130. The cement 112 exits the bottom end of production tubing string 130 and fills the annulus 142 between the exterior of production tubing string 130 and the interior of wellbore 102 (and/or between the exterior of production tubing string 130 and the interior of liner 114 or casing string 110). A wiper plug or similar device can follows the cement, and a displacement fluid above the plug can fills the central bore of the production tubing string.

While the (non-rotating) housing of production tubing hanger 140 is locked into place in the surface wellhead assembly 120, the rotating inner mandrel within the non-rotating housing of production tubing hanger 140 can be rotated by landing joint 160 (driven by a top drive or other suitable mechanism) which in turn rotates production tubing string 130. Rotation of production tubing string 130 during the cementing operations (i.e., while cement is flowing from the bottom end of production tubing string 130 and into annulus 142) can ensure more even distribution of cement in the annulus 142 between the exterior of the production tubing string and the wellbore, particularly in deep, horizontal, and/or highly deviated wells. This can in turn improve the sealing effectiveness of the cement as against high bottom-hole pressures.

After cementing of production tubing string 130 is completed, the remaining steps of the completion can be completed via conventional means (including but not limited to perforating operations to provide a path through which hydrocarbons can travel from the formation into production tubing string 130). Oil, gas, and or other hydrocarbon fluids from the subterranean formation into which wellbore 102 has been drilled can be produced through production tubing string 130. During such production, produced hydrocarbons are in contact with the interior surface of production tubing string 130.

Figure 2:
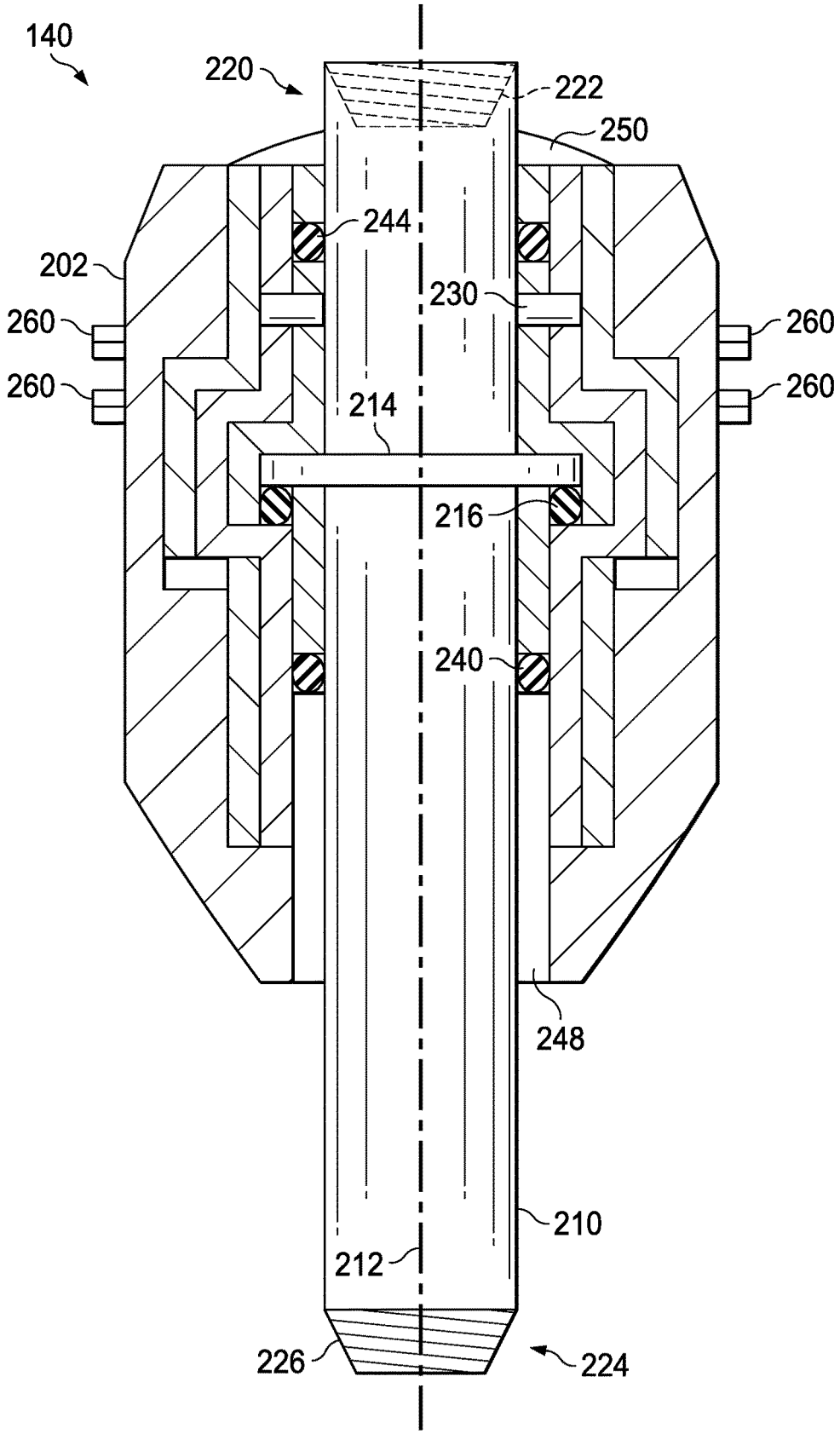
FIG. 2 is a schematic drawing of a rotating-mandrel production tubing hanger in accordance with an embodiment of the present disclosure.

FIG. 2 is a schematic drawing of a rotating-mandrel production tubing hanger in accordance with an embodiment of the present disclosure. In the illustrated embodiment, the production tubing hanger of FIG. 2 is production tubing hanger 140 configured to be installed in a surface wellhead assembly 120 of FIGS. 1A-1B.

Referring to FIG. 2, production tubing hanger 140 includes a housing 202 and a rotating inner mandrel 210. Rotating inner mandrel 210 is configured to be rotatable about axis 212 as housing 202 remains stationary (i.e., housing 202 does not rotate when it has been installed in a tubing head spool). Rotating inner mandrel 210 has a mandrel upper end 220 with upper threads 222 configured to be attached to a lower end of a landing joint. No specialized running tool is required to rotate rotating inner mandrel 210. Instead, rotating inner mandrel 210 is configured to be rotated by an ordinary landing joint (such as landing joint 160 of FIGS. 1A and 1B) which can be a segment of production tubing. Rotating inner mandrel 210 also has a mandrel lower end 224 with lower threads 226 configured to attach to an upper end of a production tubing segment (such as the upper production tubing segment of production tubing string 130 of FIGS. 1A and 1B).

Rotating inner mandrel 210 includes a mandrel collar 214 which extends circumferentially from an outer surface of rotating inner mandrel 210 and which prevents upward or downward movement of rotating inner mandrel 210 within housing 202. In the illustrated embodiment, mandrel collar 214 is in contact with bearings 216 which reduce friction between rotating inner mandrel 210 and housing 202 as rotating inner mandrel 210 rotates about axis 212.

Production tubing hanger 140 further includes lower seal element 240 and upper seal element 244 positioned in the annulus 248 between rotating inner mandrel 210 and housing 202. In the illustrated embodiment, lower seal element 240 is positioned in the housing below (in the downhole direction of) mandrel collar 214 and upper seal element 244 is positioned in the housing above mandrel collar 214. Lower seal element 240 and upper seal element 244 are configured to prevent the migration of fluids through annulus 248. Outer seals 260 are positioned on the outer surface of housing 202. In the illustrated embodiment, because of lower seal element 240 and upper seal element 244 are part of production tubing hanger 140, no pack-off or other separate sealing component around or above production tubing hanger 140 is necessary to prevent fluid migration through annulus 248. Junk bonnet 250 is positioned at an upper end of production tubing hanger 140 around rotating inner mandrel 210 and prevents dust or debris from entering annulus 248.

Production tubing hanger 140 further includes anti-rotation locks 230 which allows rotation of rotating inner mandrel 210 in one direction but prevents rotation of rotating inner mandrel 210 in the opposite direction. By preventing rotation of rotating inner mandrel 210 in one direction, anti-rotation locks 230 enables landing joint 160 to be removed from the mandrel upper end 220 by rotating landing joint 160 in the opposite direction than the thread connection direction of upper threads 222 (for example, counterclockwise for clockwise threads) as the locks prevent rotation of rotating inner mandrel 210 in that direction. Such removal can be, for example, after production tubing string 130 is cemented within the wellbore.

Figure 3:
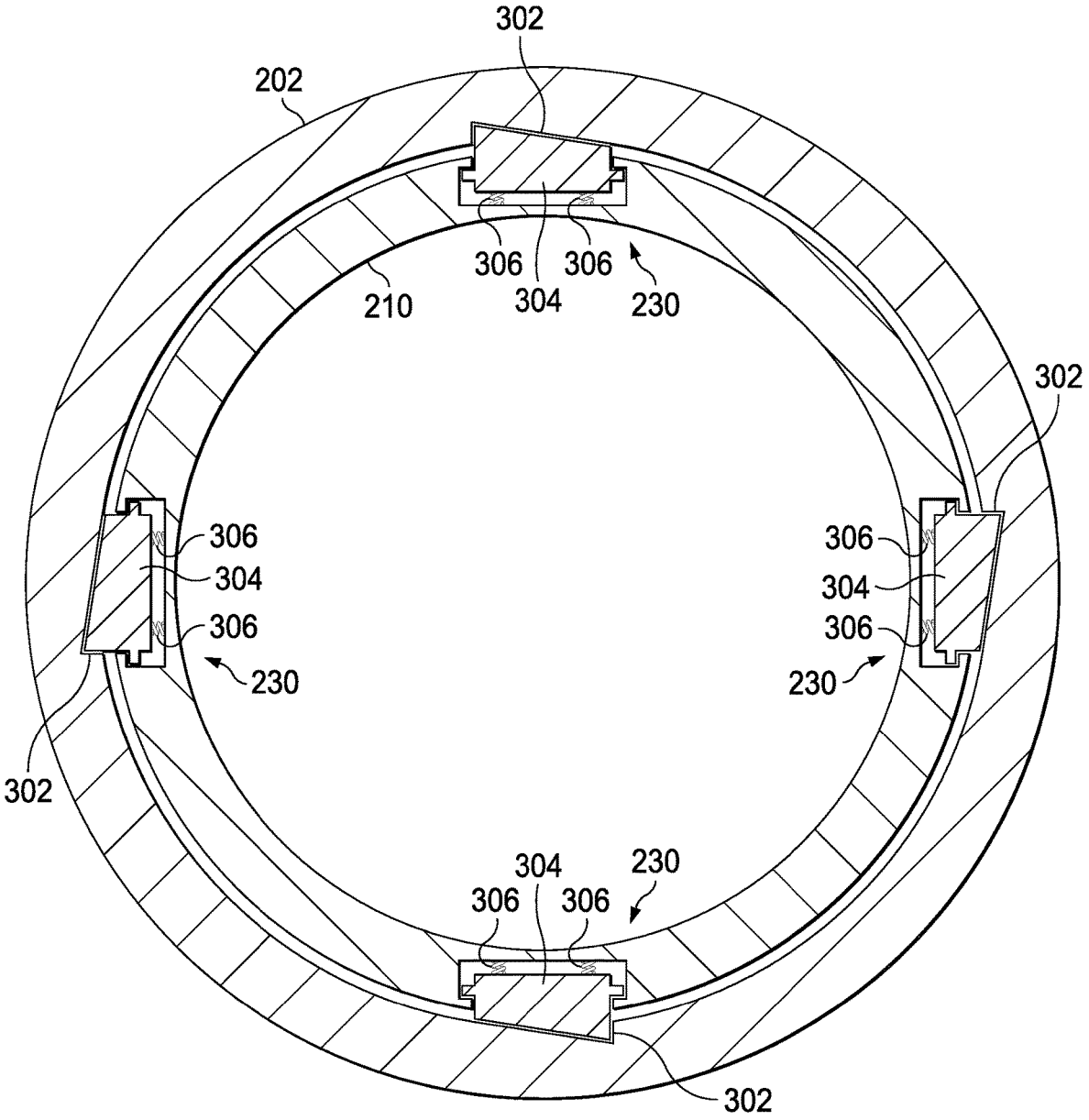
FIG. 3 is a schematic drawing of an anti-rotation lock mechanism of a rotating-mandrel production tubing hanger in accordance with an embodiment of the present disclosure.

FIG. 3 is a schematic drawing of anti-rotation lock mechanisms within a rotating-mandrel production tubing hanger in accordance with an embodiment of the present disclosure. In an embodiment, the anti-rotation lock mechanisms of FIG. 3 are anti-rotation locks 230 of production tubing hanger 140 of FIG. 2. In FIG. 3, a cross-section of production tubing hanger 140 is shown, with rotating inner mandrel 210 positioned inside housing 202. Anti-rotation profiles 302 comprise recesses within the interior surface of housing 202. Dogs 304 are attached to recesses within the exterior surface of rotating inner mandrel 210 and are biased outward by springs 306. Dogs 304 have wedge shape to correspond with wedge-shaped anti-rotation profiles 302 to allow for rotation of rotating inner mandrel 210 in one direction but to prevent rotation of rotating inner mandrel 210 in the other direction. In the illustrated embodiment, anti-rotation locks 230 are anti-counterclockwise rotation locks which allow rotation of rotating inner mandrel 210 in a clockwise direction, but prevent rotation of rotating inner mandrel 210 in a counter-clockwise direction.

FIG. 4 is a schematic drawing of a surface wellhead assembly with a rotating-mandrel production tubing hanger in accordance with an embodiment of the present disclosure. In the illustrated embodiment, the surface wellhead assembly is surface wellhead assembly 120 positioned at a surface location at an uphole end of the wellbore as shown in FIGS. 1A and 1B, after production tubing hanger 140 (as described more detail in reference to FIG. 2) has been positioned and locked within the tubing head spool of surface wellhead assembly 120. (The wellbore is not shown in FIG. 4.)

Referring to FIG. 4, surface wellhead assembly 120 includes a casing hanger 410 which supports casing string 110 and which, in turn, is supported by casing head spool 412. Casing string 110 is cemented in the wellbore as described above in reference to FIGS. 1A-1B.

Surface wellhead assembly 120 further includes tubing head spool 420 above casing head spool 412 and into which production tubing hanger 140 is positioned. As also described in reference to FIG. 2, production tubing hanger 140 includes rotating inner mandrel 210, which includes mandrel lower end 224, which is attached to an upper end of production tubing string 130, and mandrel upper end 220 which can be attached to landing joint 160.

Tie-down bolts 422 lock production tubing hanger 140 within tubing head spool 420. Outer seals 260 seal the outer portion of production tubing hanger 140 against the inner surface of tubing head spool 420. Christmas tree bonnet 430 positioned above tubing head spool 420 prevents dust and debris from entering tubing head spool 420.

Figure 5:
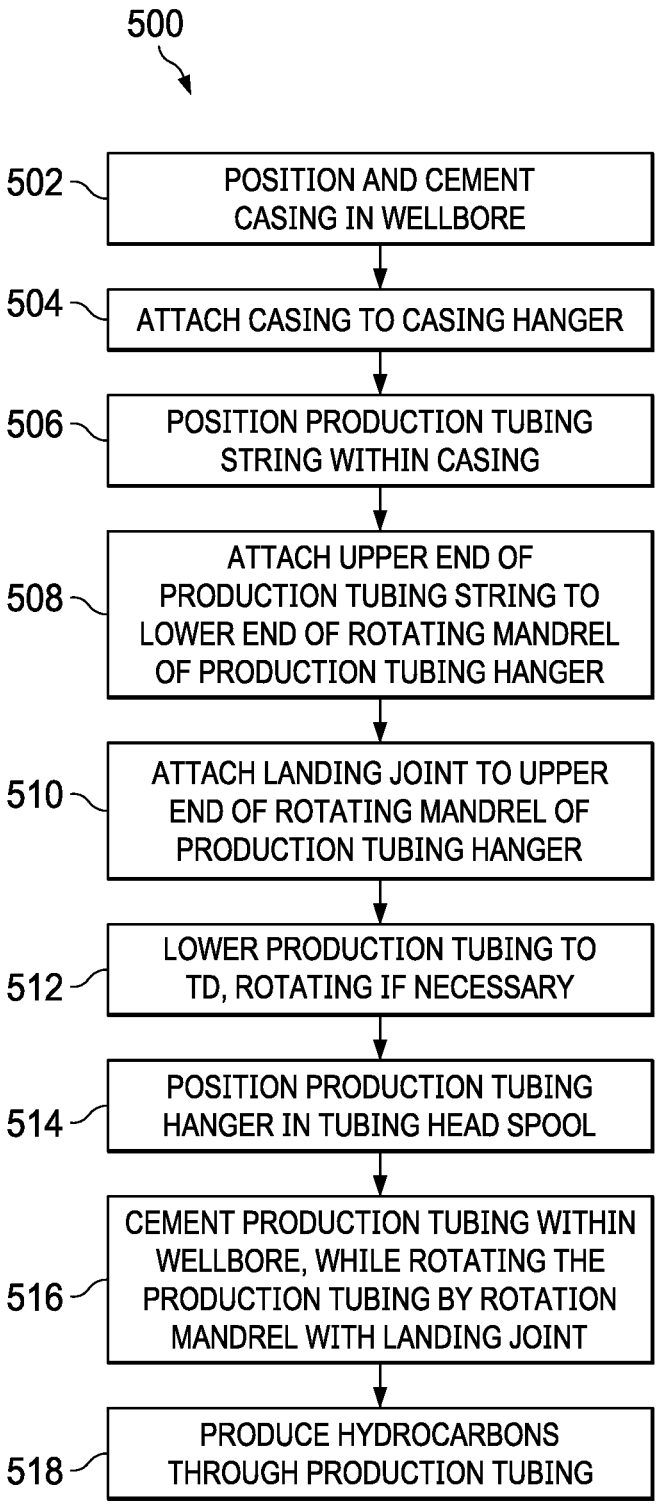
FIG. 5 is a process flow diagram of a method for utilizing a rotating-mandrel production tubing hanger in a cemented completion, accordance with an embodiment of the present disclosure.

FIG. 5 is a process flow diagram of a method for utilizing a rotation-mandrel production tubing hanger in a cemented completion, in accordance with an embodiment of the present disclosure. The method of FIG. 5 will be described in reference to the apparatus and system described in reference to FIGS. 1A-1B and 2-4; however, it will be understood that other suitable tools and components can be used in other embodiments of the present disclosure.

Method 500 of FIG. 5 begins at step 502 wherein a casing string is positioned and cemented within a wellbore. At step 504, an upper end of the casing is attached to a casing hanger and positioned within a casing head spool within a surface wellhead assembly at an uphole end of the wellbore.

At step 506, a production tubing string is positioned within the casing within the wellbore. The production tubing string is made of up multiple production tubing segments.

At step 508, an uphole end of the production tubing string is attached to a lower end of a rotating inner mandrel of a production tubing hanger. In some embodiments, the production tubing hanger can be production tubing hanger 140 as described in reference to FIG. 2. The production tubing hanger can be configured to be positioned within a tubing head spool positioned above the casing head spool. The rotating inner mandrel is configured to rotate within a non-rotating housing of the production tubing hanger. In some embodiments, the rotating inner mandrel includes a mandrel collar extending circumferentially from an outer surface of the rotating inner mandrel, and has a bearing in contact with the mandrel collar and positioned between the rotating inner mandrel and the non-rotating housing. In some embodiments, the production tubing hanger includes an upper seal element and a lower seal element positioned within an annular space between the rotating inner mandrel and the non-rotating housing. The upper sealing element can be positioned above the mandrel collar and the lower sealing element can be positioned below the mandrel collar. In some embodiments, the production tubing hanger further comprises a plurality of anti-rotation locks within the non-rotating housing which limit rotation of the rotating inner mandrel such that it only rotates in one direction, for example, in a clockwise direction or a counterclockwise rotation.

At step 510, a landing joint is attached to an upper end of the rotating inner mandrel of the production tubing hanger. In some embodiments, the landing joint can be a segment of production tubing. At step 512, the production tubing string is lowered to its final depth, and the production tubing can be rotated if necessary or desired as the production tubing string is lowered, to avoid the production tubing string from becoming stuck or to free it if it has become stuck. The production tubing can be rotated by the top drive (or other suitable rotating mechanism) rotating the landing joint which in turn rotates the rotating inner mandrel. As the production tubing string reaches its final depth, at step 514, the production tubing hanger is positioned within the tubing head spool and locked into place with tie-down bolts or other suitable apparatus.

At step 516, cement is pumped down the central bore of the production tubing string and into the annulus between the production tubing string and the wellbore (and/or between the production tubing string and the wellbore or the interior of the liner and/or casing). As described in reference to FIG. 1B, as the production tubing string is cemented into the wellbore, the production tubing string can be rotated by a top drive or other suitable rotating mechanism rotating the rotating inner mandrel of the production tubing hanger. In this way, the cement in the annulus around the production tubing string can be more evenly distributed.

After step 516 is completed the remaining steps of the completion can be completed via conventional means. At step 518, oil, gas, and or other hydrocarbon fluids from the subterranean formation into which wellbore has been drilled can be produced through the production tubing string.

In this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

While this disclosure contains many specific implementation details, these should not be construed as limitations on the subject matter or on what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Nevertheless, it will be understood that various modifications, substitutions, and alterations may be made. While operations are depicted in the drawings or claims in a particular order, this should not be understood as requiring that such operations be performed in the particular order shown or in sequential order, or that all illustrated operations be performed (some operations may be considered optional), to achieve desirable results. Accordingly, the previously described example implementations do not define or constrain this disclosure.

The invention claimed is:

1. A method comprising:

positioning a casing into a wellbore;

pumping cement through the casing to cement the casing in the wellbore;

positioning a casing hanger within a casing head spool that is part of a surface wellhead assembly at an uphole end of the wellbore, wherein the casing hanger is attached to an uphole end of the casing;

positioning a production tubing string within the casing within the wellbore, the production tubing string comprising a plurality of production tubing segments;

attaching an uphole end of the production tubing string to a lower end of a rotating inner mandrel of a production tubing hanger, wherein the production tubing hanger is configured be positioned within a tubing head spool positioned above the casing head spool within the surface wellhead assembly, wherein the rotating inner mandrel is configured to rotate within a non-rotating housing of the production tubing hanger and the production tubing hanger further comprises a plurality of anti-rotation locks within the non-rotating housing which limit rotation of the rotating inner mandrel to one of a clockwise direction or a counterclockwise direction;

rotating the production tubing string by rotating a landing joint attached to an upper end of the rotating inner mandrel, wherein the landing joint comprises a production tubing segment; and while rotating the production tubing string, pumping cement through the production tubing string to at least partially cement the production tubing string within the wellbore.

2. The method of claim 1, further comprising rotating the production tubing string before landing the production tubing string at a final depth by rotating the rotating inner mandrel with the landing joint before positioning the production tubing hanger within the tubing head spool.

3. The method of claim 1, further comprising producing hydrocarbons through the production tubing string, wherein produced hydrocarbons are in contact with an interior surface of the production tubing string.

4. The method of claim 1, wherein the anti-rotation locks comprise a plurality of wedge-shaped profiles within the non-rotating housing.

5. The method of claim 1, wherein the rotating inner mandrel further comprises a mandrel collar extending circumferentially from an outer surface of the rotating inner mandrel, and wherein the production tubing hanger further comprises:

a bearing in contact with the mandrel collar and positioned between the rotating inner mandrel and the non-rotating housing;

an upper seal element and a lower seal element positioned within the hanger and within an annular space between the rotating inner mandrel and the non-rotating housing, the upper sealing element positioned above the mandrel collar and the lower sealing element positioned below the mandrel collar.

6. The method of claim 1, wherein the landing joint is attached to the rotating inner mandrel with threads.

7. The method of claim 1, wherein a bottom portion of the production tubing string is cemented into the wellbore, thereby forming a partially cemented long-string completion.

8. A hydrocarbon production system comprising;

a casing hanger positioned within a casing head spool that is part of a surface wellhead assembly at an uphole end of a wellbore;

a casing cemented into the wellbore, wherein an upper end of the casing is attached to the casing hanger;

a production tubing hanger configured to be positioned within a tubing head spool positioned above the casing head spool within the surface wellhead assembly, wherein the production tubing hanger comprises:

a rotating inner mandrel within a non-rotating housing, the rotating inner mandrel comprising a mandrel collar extending circumferentially from an outer surface of the rotating inner mandrel and in contact with a bearing positioned between the rotating inner mandrel and the non-rotating housing;

an upper seal element and a lower seal element positioned within the hanger and within an annular space between the rotating inner mandrel and the non-rotating housing, the upper sealing element positioned above the mandrel collar and the lower sealing element positioned below the mandrel collar; and a plurality of anti-rotation locks within the non-rotating housing which limit rotation of the rotating inner mandrel to one of a clockwise direction or a counterclockwise direction; and a production tubing string positioned within the casing, wherein an upper end of the production tubing string is attached to a lower end of the rotating inner mandrel, wherein the production tubing string comprises a plurality of production tubing segments, and wherein the production tubing string is at least partially cemented into the wellbore by pumping cement into the production tubing string while the production tubing string is rotated, and wherein rotation of the production tubing string is by rotating a landing joint comprising a production tubing segment attached to an upper end of the rotating inner mandrel.

9. The hydrocarbon production system of claim 8, wherein the anti-rotation locks comprise a plurality of wedge-shaped profiles within the non-rotating housing.

10. The hydrocarbon production system of claim 8, wherein the landing joint is attached to the rotating inner mandrel with threads.

11. The hydrocarbon production system of claim 8, further comprising tie bolts to lock the production tubing hanger within the tubing head spool.

12. The hydrocarbon production system of claim 8, wherein a bottom portion of the production tubing string is cemented into the wellbore, thereby forming a partially cemented long-string completion.

13. The hydrocarbon production system of claim 8, wherein hydrocarbons are produced through the production tubing string, wherein produced hydrocarbons are in contact with an interior surface of the production tubing string.

* * * * *